US010826229B2

(12) United States Patent
Hirano

(10) Patent No.: US 10,826,229 B2
(45) Date of Patent: Nov. 3, 2020

(54) CONNECTOR WITH COUPLING PORTION

(71) Applicant: Sumitomo Wiring Systems, Ltd., Mie (JP)

(72) Inventor: Shinji Hirano, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/693,602

(22) Filed: Nov. 25, 2019

(65) Prior Publication Data

US 2020/0169032 A1 May 28, 2020

(30) Foreign Application Priority Data

Nov. 27, 2018 (JP) ..... 2018-221143

(51) Int. Cl.

| | |
|---|---|
| ***H01R 13/58*** | (2006.01) |
| ***H01R 13/10*** | (2006.01) |
| ***H01R 24/28*** | (2011.01) |
| *H01R 101/00* | (2006.01) |

(52) U.S. Cl.

CPC ..... *H01R 13/582* (2013.01); *H01R 13/10* (2013.01); *H01R 24/28* (2013.01); *H01R 2101/00* (2013.01)

(58) Field of Classification Search

CPC ..... H01R 13/11; H01R 13/428; H01R 13/10; H01R 24/28; H01R 2101/00

USPC ..... 439/460, 854, 85, 749, 694

See application file for complete search history.

(56) References Cited

U.S. PATENT DOCUMENTS 3,860,315 A * 1/1975 Tetreault ..... H01R 13/527 439/186
5,435,754 A * 7/1995 Hotea ..... H01R 13/6616 439/620.21
7,192,317 B2 * 3/2007 Nakagawa ..... B29C 45/14639 439/736
7,591,694 B2 * 9/2009 Osada ..... H01R 4/185 439/852
9,009,962 B2 * 4/2015 Sugie ..... H01R 43/16 29/882
9,124,024 B2 * 9/2015 Itsuki ..... H01R 24/20
9,692,171 B2 * 6/2017 Suzuki ..... H01R 13/5205
9,793,618 B2 * 10/2017 Sone ..... H01R 24/38

(Continued)

FOREIGN PATENT DOCUMENTS

JP 2008-152990 7/2008

*Primary Examiner* — Harshad C Patel

(74) *Attorney, Agent, or Firm* — Gerald E. Hespos; Michael J. Porco; Matthew T. Hespos

(57) ABSTRACT

A connector (10) includes terminals (14) and a housing (12) with terminal accommodating portions (36) to accommodate the terminals (14). Each terminal (14) includes a terminal connecting portion (18) extending in a front-rear direction and a vertical wire connecting portion (20) perpendicular to the front-rear direction. A first coupling portion (22A) extends in the front-rear direction from a rear end of the terminal connecting portion (18), and a second coupling portion (22B) extends vertically from an extending end of the first coupling (22A) to the wire connecting portion (20). Projections (30) project from sides of the first coupling portion (22A) in a third direction perpendicular to the front-rear direction and the vertical direction. Grooves (42) are open in inner walls (38A) of the terminal accommodating portion (36) facing each other in the third direction, and the projections (30) contact inner walls of the grooves (42) in the vertical direction.

6 Claims, 8 Drawing Sheets

(56) References Cited

U.S. PATENT DOCUMENTS

| | | | | |
|---|---|---|---|---|
| 2001/0007801 | A1* | 7/2001 | Nimura | H01R 13/639<br>439/489 |
| 2002/0137397 | A1* | 9/2002 | Little | H01R 13/7032<br>439/686 |
| 2004/0209488 | A1* | 10/2004 | Nimura | H01R 13/5829<br>439/38 |
| 2006/0086900 | A1* | 4/2006 | Nakamura | H01R 13/6633<br>250/239 |
| 2010/0029142 | A1* | 2/2010 | Hiramitsu | H01R 13/11<br>439/741 |
| 2013/0065426 | A1* | 3/2013 | Yamashita | H01R 13/187<br>439/449 |
| 2014/0141637 | A1* | 5/2014 | Miyakawa | H01R 13/641<br>439/246 |

* cited by examiner

CONNECTOR WITH COUPLING PORTION

BACKGROUND

Field of the Invention

This specification relates to a connector.

Related Art

Japanese Unexamined Patent Publication No. 2008-152990 discloses a connector that includes a connector housing and terminal fittings to be mounted into the connector housing from behind.

The terminal fitting includes a tubular body that extends in a front-rear direction and has open front and rear ends. A wire connecting portion extends substantially perpendicular to the front-rear direction of the body and is to be crimped and connected to an end of a wire. A coupling extends from the rear end of the body to the wire connecting portion and is substantially L-shaped when viewed laterally.

The connector housing is composed of an accommodating portion in the form of a vertically long thick plate and a tower projects forward from an upper part of the accommodating portion so that the connector housing is substantially L-shaped. Cavities are formed in the tower and can receive the bodies of the terminal fittings so that the body of each terminal fitting is in a substantially horizontal posture along the front-rear direction.

If the wire is pulled in the extending direction, a load acts on the coupling of the terminal fitting and the coupling may deform or break.

SUMMARY

A connector disclosed in this specification has a terminal and a housing including a terminal accommodating portion configured to accommodate the terminal. The terminal includes a terminal connecting portion extending in a first direction and a wire connecting portion extending in a second direction perpendicular to the first direction. The wire connecting portion is to be connected to an end of a wire extending in the second direction. A plate-like coupling couples the terminal connecting portion and the wire connecting portion. The coupling includes a first and second coupling portions. The first coupling portion is connected to the terminal connecting portion and extends in the first direction. The second coupling portion extends in the second direction from an extending end of the first coupling portion toward the wire connecting portion. A projection projects from a side edge of the first coupling portion in a third direction perpendicular to both the first and second directions. A groove is open in a third inner wall of the terminal accommodating portion of the housing and faces in the third direction. The groove is configured to accommodate the projection so that the projection can contact an inner wall of the groove in the second direction.

The contact of the projection of the coupling with the inner wall of the groove in the terminal accommodating portion is in the second direction. This contact prevents the coupling from being deformed or broken by being pulled in the second direction when the wire connecting portion is pulled in the second direction, for example, when the wire extending in the second direction is pulled in the second direction.

The terminal accommodating portion of the housing may include a tubular first accommodating portion extending in the first direction, and the terminal connecting portion of the terminal may be accommodated into the first accommodating portion. A locking lance may be provided on a second inner wall facing in the second direction, and the locking lance may be resiliently displaceable in the second direction. A lock may project on the locking lance and may be inserted into a locking hole in the terminal connecting portion. The lock may contact an inner wall of the lock hole to suppress a displacement of the terminal in the first direction. The lock of the locking lance may slide on a surface of the terminal connecting portion in which the lock hole is formed and may be displaced resiliently in the second direction with the projection accommodated in the groove portion when the terminal connecting portion is accommodated into the first accommodating portion.

The projection of the terminal is accommodated in the groove of the housing during the insertion of the terminal connecting portion into the first accommodating portion and before the terminal connecting portion contacts the lock of the locking lance. The lock of the locking lance resiliently contacts the surface of the terminal connecting portion that has the lock hole and urges the terminal connecting portion in the second direction. However, at this time, the projection already is in contact with the inner wall of the groove in the second direction. Thus, a displacement of the terminal connecting portion in the second direction can be suppressed and the terminal connecting portion can be inserted in a stable posture into the first accommodating portion.

The terminal connecting portion may be open rearward, and the first coupling portion may be connected to an opening edge located on a side opposite to the second coupling portion in the second direction. Thus, the entire terminal can be reduced in size in the second direction, as compared to the case where the first coupling portion is connected to an opening edge located on the side of the second coupling portion. Associated with this, the terminal accommodating portion of the housing configured to accommodate the terminal also can be reduced in size.

Two of the projections may be provided on both side edges of the first coupling portion, and two of the grooves may be provided in two of the third inner walls. Thus, a displacement of the first coupling portion in the second direction is suppressed more firmly.

Accordingly, the coupling that couples the terminal connecting portion and the wire connecting portion is not likely to be deformed or broken if the wire connected to the L-shaped terminal is pulled down.

DETAILED DESCRIPTION

An embodiment is described with reference to FIGS. 1 to 8. In the following description, an X side in FIGS. 1 to 8 is referred to as a front in a front-rear direction (first direction), a Z side is referred to as an upper side in a vertical direction (second direction perpendicular to the first direction) and a Y side is referred to as a right side in a lateral direction (third direction perpendicular to the first direction and the second direction).

Figure 1:
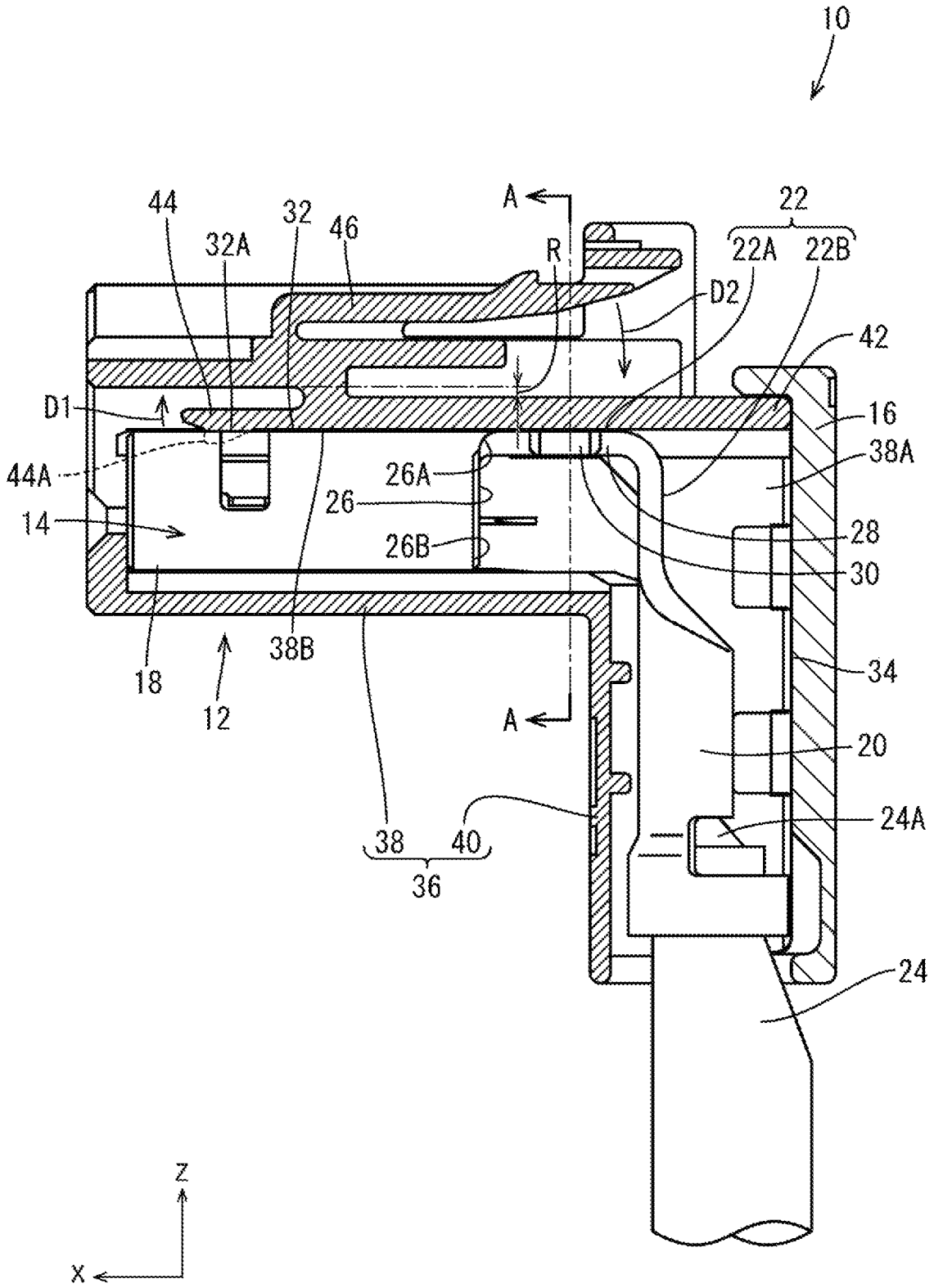
FIG. 1 is a side view partly in section of a connector in a state where a terminal is accommodated.

As shown in FIG. 1, a connector 10 includes an L-shaped housing 12, an L-shaped terminal 14 to be accommodated into the housing 12, and a retainer 16.

Figure 6:
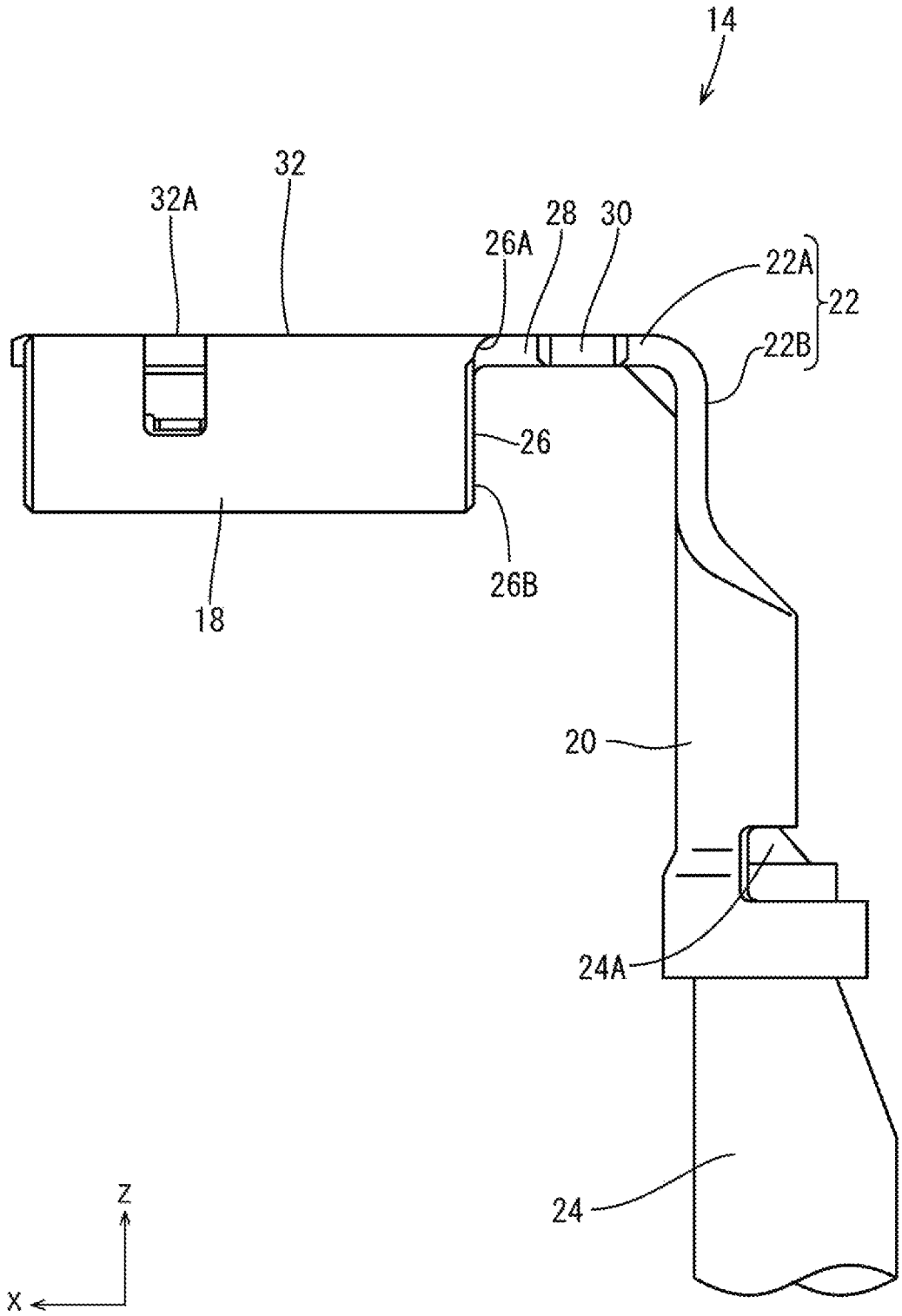
FIG. 6 is a side view of the terminal.

As shown in FIG. 6, the terminal 14 includes a rectangular tubular terminal connecting portion 18 that is open in the front-rear direction, a wire connecting portion 20 extending in the vertical direction, and a plate-like coupling 22 that couples the terminal connecting portion 18 and the wire connecting portion 20. As shown in FIG. 6, an end 24A of a wire 24 is crimped and connected to the wire connecting portion 20, and the wire 24 extends down from the wire connecting portion 20.

Figure 7:
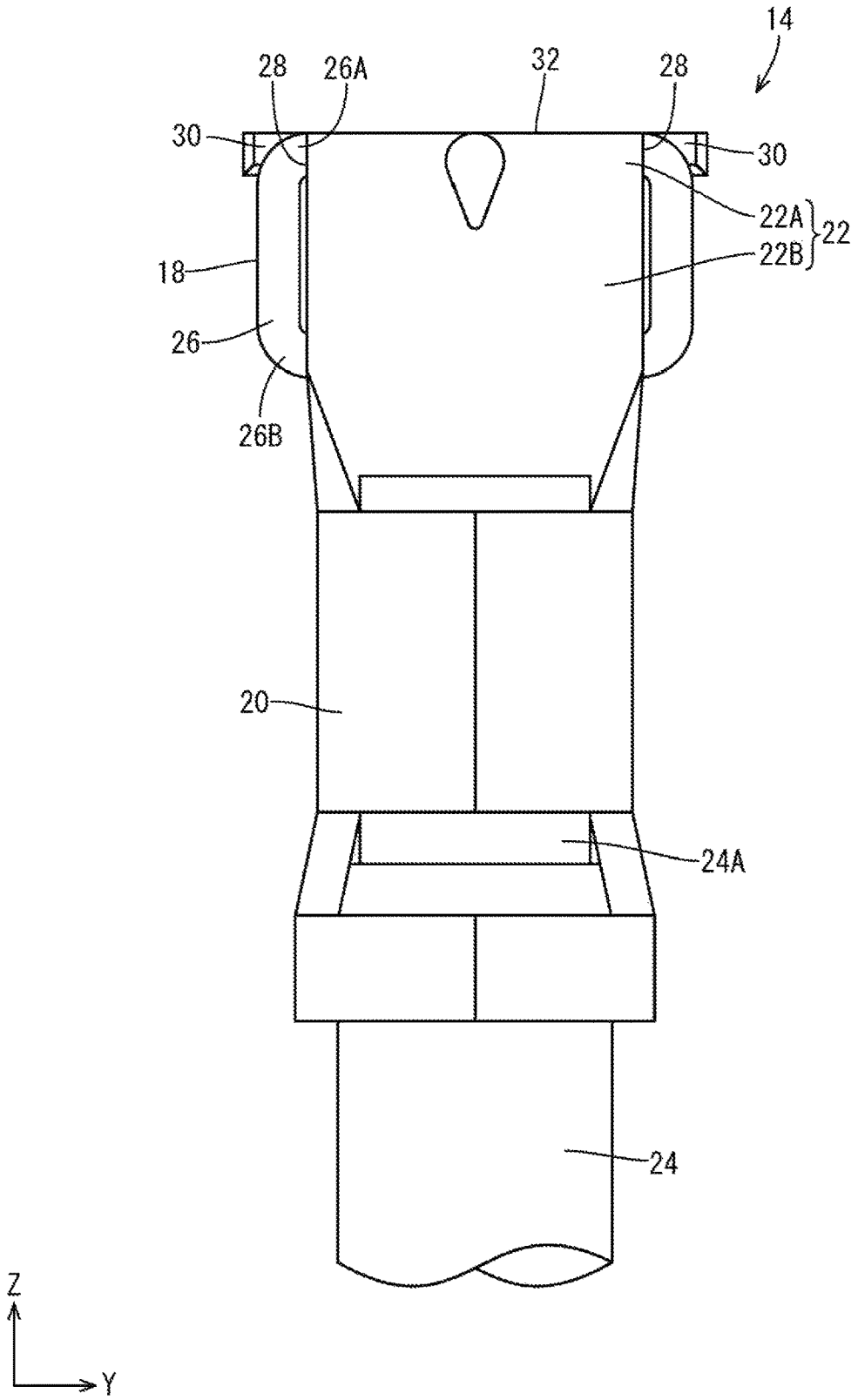
FIG. 7 is a back view of the terminal.
Figure 8:
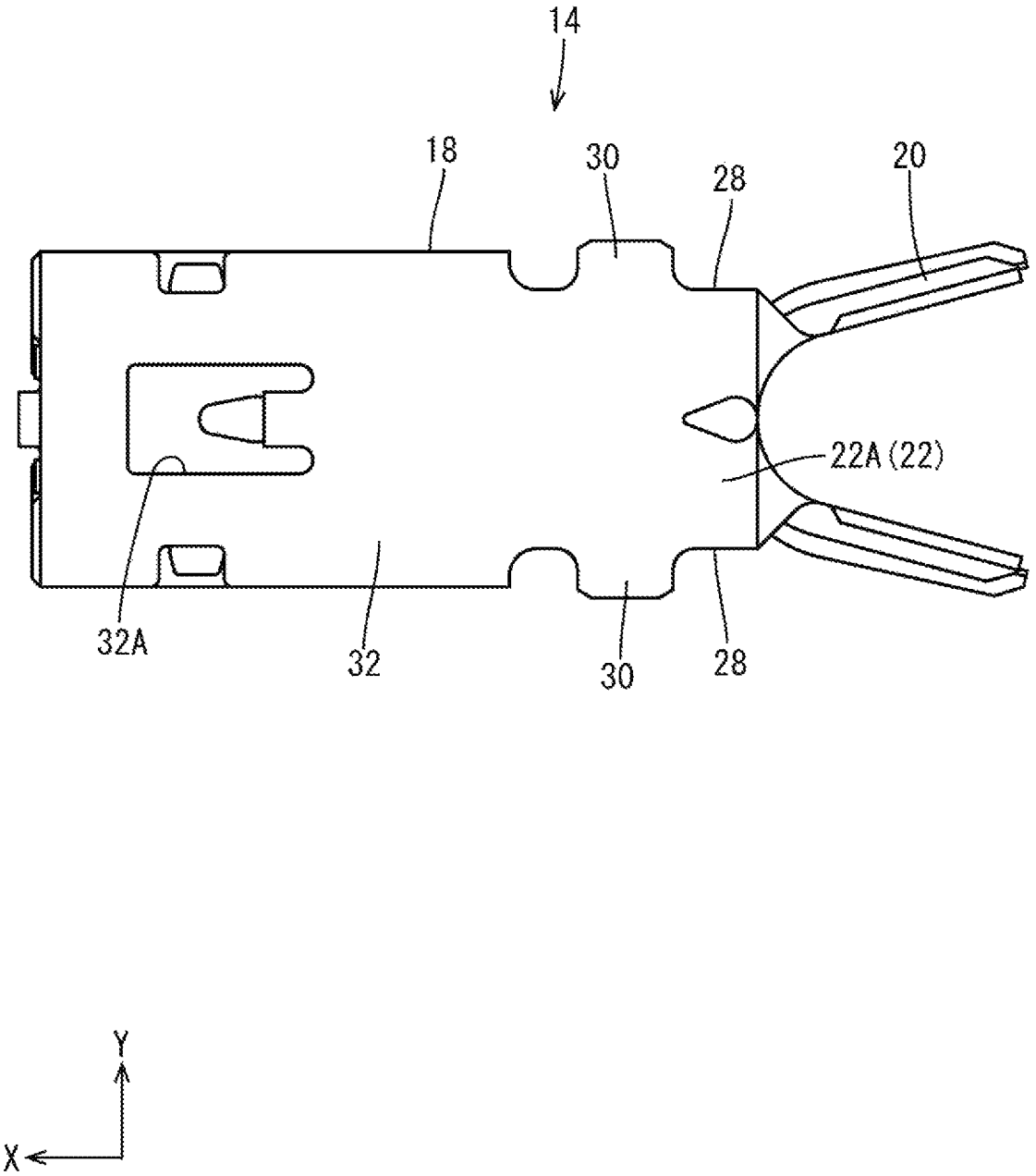
FIG. 8 is a plan view of the terminal before crimping.

As shown in FIG. 6, the coupling 22 is composed of a first coupling portion 22A extending rearward from a rear end opening edge 26 of the terminal connecting portion 18 and a second coupling portion 22B extending down from the rear extending end of the first coupling portion 22A to the wire connecting portion 20. As shown in FIGS. 7 and 8, two projections 30 respectively project left and right from left and right side edges 28 of the first coupling portion 22A.

As shown in FIG. 6, the first coupling portion 22A is connected to an opening edge 26A on a side opposite to the second coupling portion 22B in the vertical direction (i.e. located on an upper side). In this way, a vertical length of the entire terminal 14 can be made shorter by a vertical length of the terminal connecting portion 18 as compared to the case where the first coupling 22A is connected to an opening edge 26B located on the lower side of the second coupling portion 22B, and the terminal 14 can be reduced in size. Associated with this, a later-described terminal accommodating portion 36 of the housing 12 for accommodating the terminal 14 also can be reduced in size in the vertical direction.

As shown in FIG. 8, a lock hole 32A is open in an upper surface 32 of the terminal connecting portion 18 and receives a lock 44A of a locking lance 44 of the housing 12.

Figure 4:
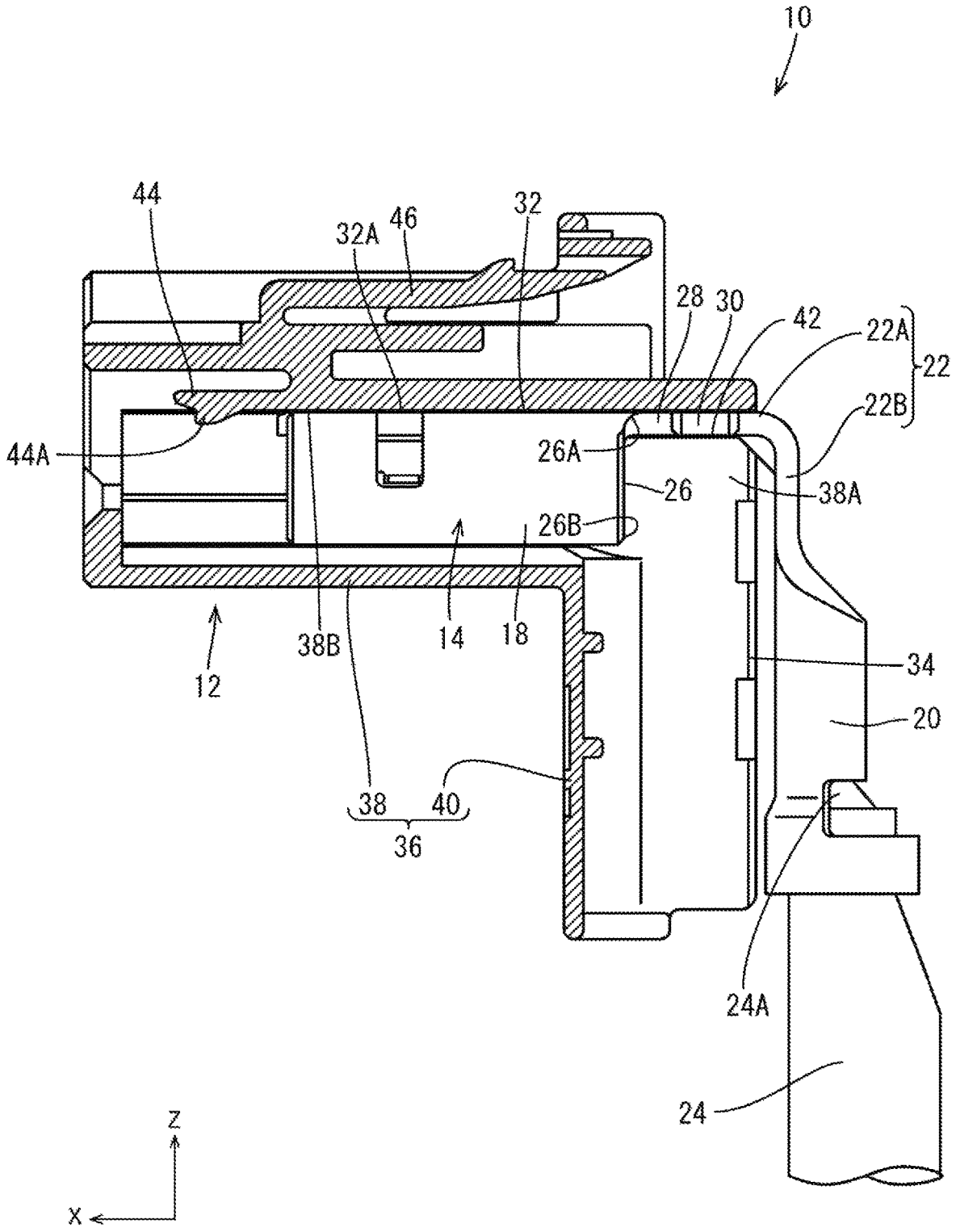
FIG. 4 is a side view partly in section of the connector in a state while the terminal is being accommodated.
Figure 5:
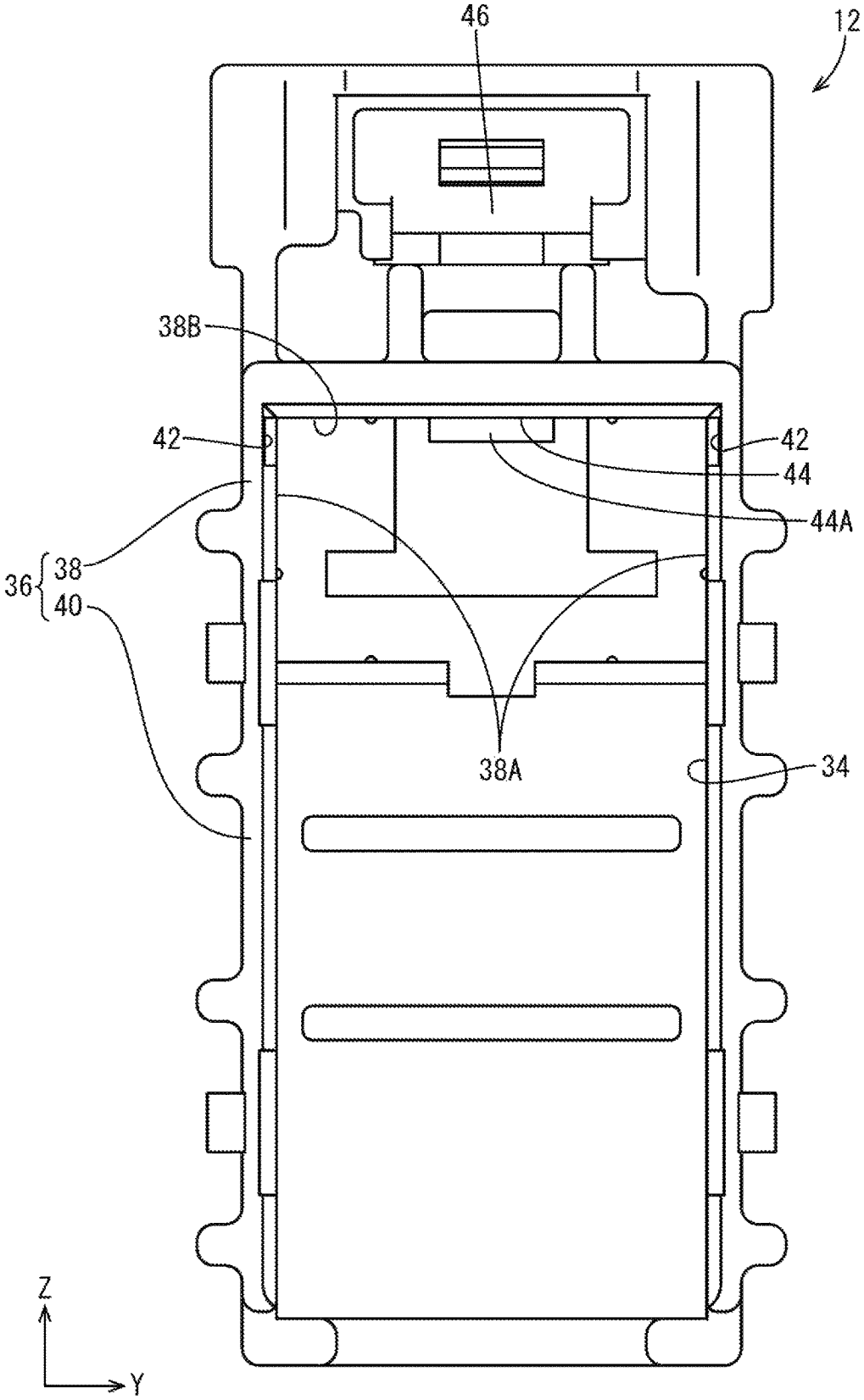
FIG. 5 is a back view of a housing.

As shown in FIGS. 1 and 4, the housing 12 is L-shaped and includes the terminal accommodating portion 36 having a rear opening 34, and the terminal 14 is accommodated into the terminal accommodating portion 36 from behind through the rear opening 34. As shown in FIG. 1, the terminal accommodating portion 36 has first and second accommodating portions 38 and 40. The first accommodating portion 38 is a rectangular tube extending in the front-rear direction and accommodates the terminal connecting portion 18 and the coupling 22 of the terminal 14 inside. The second accommodating portion 40 extends vertically down from a rear end of the first accommodating portion 38 and is configured to accommodate the wire connecting portion 20 of the terminal 14 inside. The insides of the first and second accommodating portions 38 and 40 communicate with each other.

As shown in FIGS. 1 and 4, the first accommodating portion 38 is open both forward and rearward. An unillustrated mating terminal is inserted through a front opening of the first accommodating portion 38 and is fit into the terminal connecting portion 18 of the terminal 14. The second accommodating portion 40 is open both down and rearward, and the wire 24 is inserted through a lower opening of the second accommodating portion 40.

Figure 2:
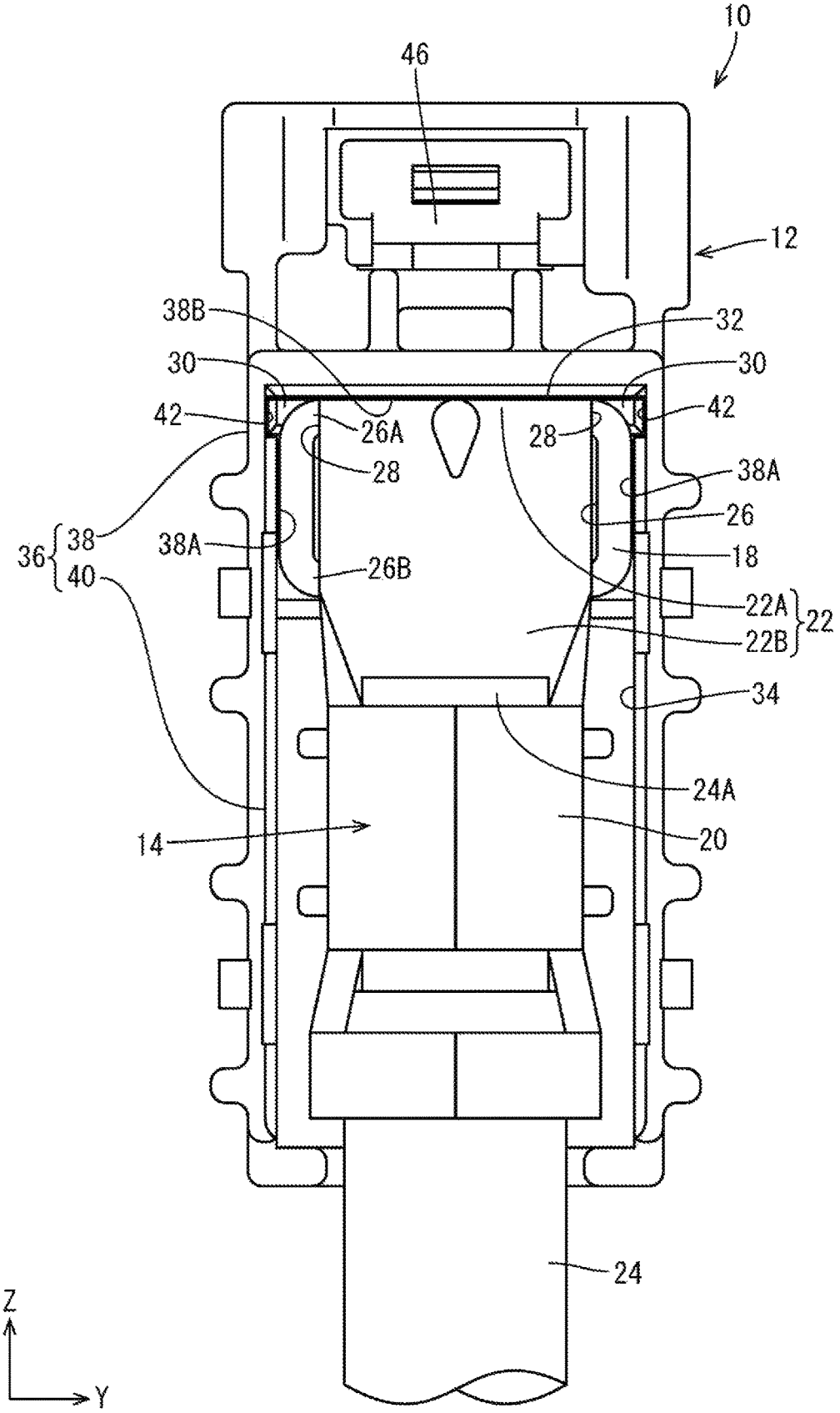
FIG. 2 is a back view of the connector.
Figure 3:
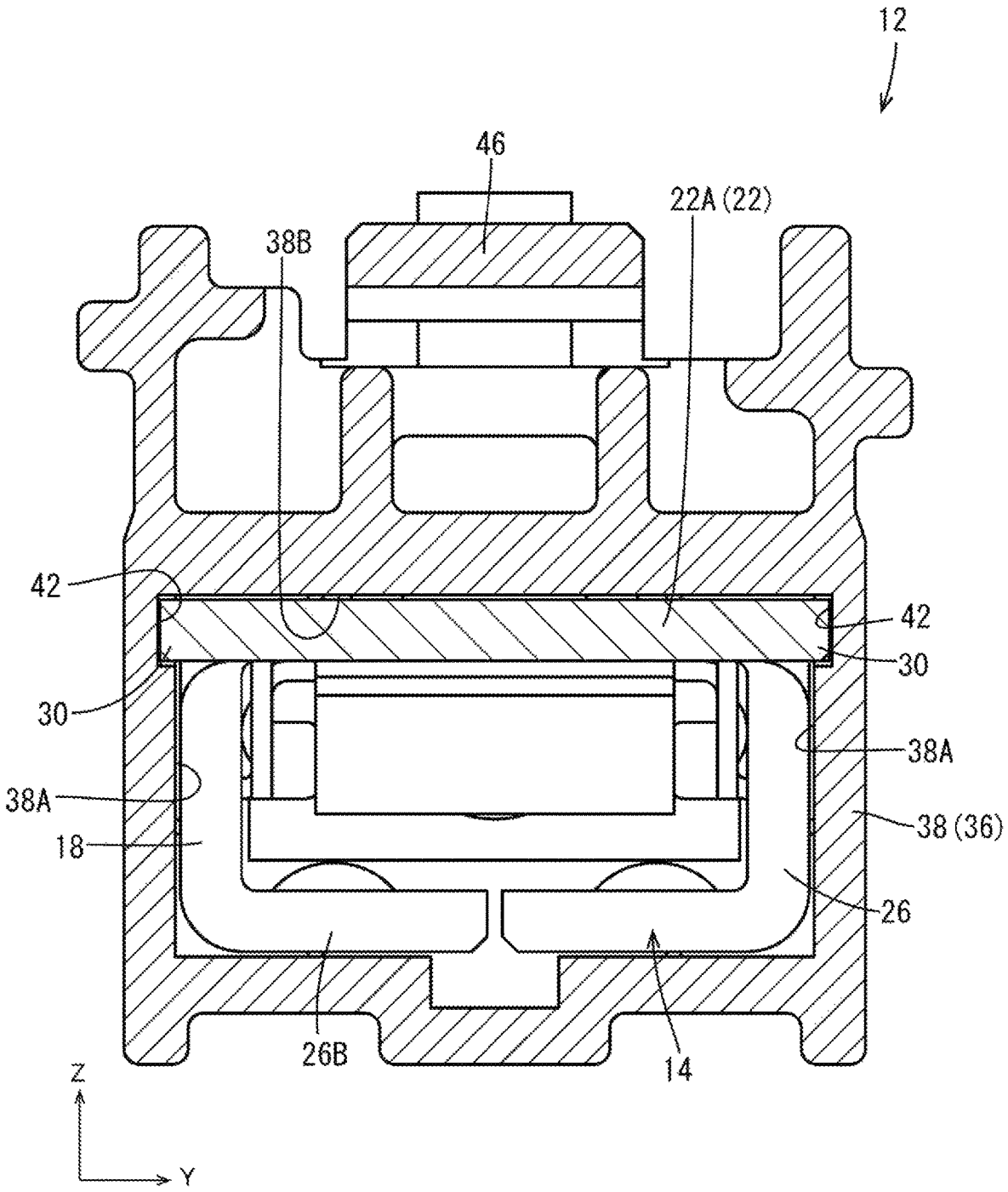
FIG. 3 is a section along A-A in FIG. 1.

The first accommodating portion 38 includes two second inner walls 38B facing each other in the vertical direction and two third inner walls 38A facing each other in the lateral direction. As shown in FIGS. 1 to 3, two grooves 42 extend in the front-rear direction in the left and right inner walls 38A of the first accommodating portion 38. The rear ends of the grooves 42 are located in the rear opening 34. The grooves 42 are bottomed recesses recessed leftward and rightward from the inside of the first accommodating portion 38, and also rearward. The projections 30 of the terminal 14 are accommodated into the grooves 42 through the rear opening 34.

As shown in FIGS. 1 and 4, the locking lance 44 is cantilevered forward on a front part of the upper inner wall (second inner wall) 38B of the first accommodating portion 38. The lock 44A projects down on a front part of the locking lance 44. When the terminal connecting portion 18 of the terminal 14 is accommodated into the first accommodating portion 38 from behind, the lock 44A of the locking lance 44 is displaced up and is inserted into the lock hole 32A in the upper surface 32 of the terminal connecting portion 18 while the lock 44A of the locking lance 44 and the upper surface 32 of the terminal connecting portion 18 are sliding on each other. When the lock 44A of the locking lance 44 is inserted into the lock hole 32A, the locking lance 44 returns to an initial position and the lock 44A of the locking lance 44 is located to contact an inner wall of the lock hole 32A. In this way, when the terminal 14 is displaced rearward, the inner wall of the lock hole 32A contacts the lock 44A of the locking lance 44 from the front to prevent the rearward escape of the terminal 14.

As shown in FIG. 1, a rearwardly cantilevered lock arm 46 is provided on the upper surface of the first accommodating portion 38. The lock arm 46 is displaced resiliently down and engages an unillustrated protrusion of an unillustrated mating housing when being fit to the mating housing. A front part of the locking lance 44 is displaced resiliently in an upward direction D1 and a rear part of the lock arm 46 when the lock arm 46 is displaced resiliently in a downward direction D2 to partially overlap in a range R in the vertical direction. In this way, the housing 12 is reduced in size in the vertical direction.

As shown in FIGS. 1 and 4, the projections 30 of the terminal 14 enter the grooves 42 of the housing 12 from behind as the terminal 14 is accommodated into the housing 12. When the projections 30 of the terminal 14 are located on rear ends of the grooves 42, as shown in FIG. 4, the front end of the upper surface 32 of the terminal connecting portion 18 of the terminal 14 is behind the lock 44A of the locking lance 44 of the first accommodating portion 38. Further, when the terminal connecting portion 18 of the terminal 14 is displaced forward, the lock 44A of the locking lance 44 and the upper surface 32 of the terminal connecting portion 18 slide on each other to displace the locking lance 44 up. At this time, a front of the terminal connecting portion 18 is pressed down by a reaction force of the locking lance 44, and a rear end of the terminal connecting portion 18 is biased up. However, the projections 30 of the terminal 14 are accommodated in the grooves 42, and the projections 30 of the terminal 14 contact inner walls of the grooves 42 from below to suppress an upward displacement of the terminal connecting portion 18. In this way, the terminal connecting portion 18 can be inserted in a stable posture into the first accommodating portion 38.

If the wire 24 is pulled down with the terminal 14 accommodated is in the terminal accommodating portion 36 of the housing 12, the projections 30 on the first coupling 22A contact the inner walls of the grooves 42 of the first accommodating portion 38 from above to suppress a downward displacement of the first coupling 22A and to suppress deformation or breakage of the coupling 22. The terminal 14 includes the left and right projections 30. Thus, a downward displacement of the first coupling portion 22A is suppressed more firmly as compared to a configuration where only one of the left and right projections is provided.

As described above, the projections 30 on the coupling 22 are located to contact the inner walls of the grooves 42 provided in the terminal accommodating portion 36 of the housing 12 in the vertical direction. Thus, the projections 30 contact the inner walls of the grooves 42 of the housing 12, for example, when the wire 24 extending in the vertical direction is pulled in the vertical direction and the wire connecting portion 20 is pulled in the vertical direction. Thus, the coupling 22 that is pulled in the vertical direction is not likely to be deformed or broken.

When inserting the terminal connecting portion 18 into the first accommodating portion 38, the projections 30 of the terminal 14 enter the grooves 42 of the housing 12 before the terminal connecting portion 18 contacts the lock 44A of the locking lance 44. In this way, when the terminal connecting portion 18 contacts the lock 44A of the locking lance 44, the lock 44A of the locking lance 44 contacts the upper surface 32 of the terminal connecting portion 18 in the vertical direction (second direction) to displace the terminal connecting portion 18 vertically. However, at this time, the projections 30 contact the inner walls of the grooves 42 in the vertical direction so that a displacement of the terminal connecting portion 18 in the vertical direction is suppressed and the terminal connecting portion 18 can be inserted in a stable posture into the first accommodating portion 38.

Further, the first coupling 22A is connected to the opening edge 26A located on the side opposite to the second coupling 22B, thus the entire terminal 14 can be reduced in size in the vertical direction (second direction) as compared to the case where the first coupling 22A is connected to the opening edge 26A located on the side of the second coupling portion 22B. Associated with this, the terminal accommodating portion 36 of the housing 12 into which the terminal 14 is accommodated can also be reduced in size.

Further, the projections 30 are brought into contact with the inner walls of the grooves 42 so that a vertical displacement of the first coupling 22A.

This specification is not limited to the above described and illustrated embodiment. For example, the following various modes are also included.

Although the terminal 14 is provided with the two projections 30 in the above embodiment, only one projection may be provided.

The terminal accommodating portion 36 of the housing 12 is composed of the first accommodating portion 38 and the second accommodating portion 40 in the above embodiment. However, the second accommodating portion may not be provided and the wire connecting portion of the terminal may be exposed to outside.

Although the locking lance 44 is provided on the front part of the upper inner wall 38B of the first accommodating portion 38 in the above embodiment, the locking lance may be provided on any one of the lower inner wall and the both left and right inner walls of the first accommodating portion. In this case, the lock hole of the terminal connecting portion also is provided at a position corresponding to the locking lance.

LIST OF REFERENCE SIGNS

10: connector
12: housing
14: terminal
18: terminal connecting portion
20: wire connecting portion
22: coupling
22A: first coupling portion
22B: second coupling portion
24: wire
24A: end
26: rear end opening edge
26A, 26B: opening edge
28: side edge
30: projection
32: upper surface
32A: lock hole
36: terminal accommodating portion
38: first accommodating portion
38A: inner wall (third inner wall)
38B: inner wall (second inner wall)
42: groove
44: locking lance
44A: lock

What is claimed is:

1. A connector (10), comprising:

a terminal (14); and a housing (12) including a terminal accommodating portion (36) configured to accommodate the terminal (14);

wherein:

the terminal (14) includes a terminal connecting portion (18) extending in a first direction, a wire connecting portion (20) extending in a second direction perpendicular to the first direction and to be connected to an end of a wire (24) extending in the second direction, and a coupling (22) that couples the terminal connecting portion (18) and the wire connecting portion (20);

the coupling (22) includes:

a first coupling portion (22A) connected to the terminal connecting portion (18) and extending in the first direction;

a second coupling portion (22B) extending in the second direction from an extending end of the first coupling portion (22A) toward the wire connecting portion (20); and a projection (30) projecting from a first side edge (28) of the first coupling portion (22A) in a third direction perpendicular to both the first direction and the second direction; and a groove (42) in a third inner wall (38A) of the terminal accommodating portion (36) of the housing (12) and open in a third direction, the groove (42) being configured to accommodate the projection (30), and the projection (30) being located to contact an inner wall of the groove (42) in the second direction.

2. The connector (10) of claim 1, wherein:

the terminal accommodating portion (36) includes a first accommodating portion (38) having a tubular shape extending in the first direction, the terminal connecting portion (18) being accommodated into the first accommodating portion (38);

a locking lance (44) including a lock (44A) resiliently displaceable in the second direction and provided on a second inner wall of the first accommodating portion (38) and facing in the second direction;

the terminal connecting portion (18) includes a lock hole (32A), the lock (44A) being inserted into the lock hole (32A), and a displacement of the terminal (14) in the first direction is suppressed by the lock (44A) contacting an inner wall of the lock hole (32A); and the lock (44A) of the locking lance (44) slides on a surface of the terminal connecting portion that has the lock hole (32A), and is displaced resiliently in the second direction with the projection (30) accommodated in the groove (42) when the terminal connecting portion (14) is accommodated into the first accommodating portion (38).

3. The connector of claim 2, wherein:

the terminal connecting portion (18) is open rearward; and the first coupling portion (22A) is connected to a rear opening edge located on a side opposite to the second coupling portion (22B) in the second direction.

4. The connector of claim 3, wherein the first coupling portion (22A) has opposite first and second side edges (28), the projection (30) is a first projection (30) and projects from the first side edge (28) of the first coupling portion (22A), and the terminal (14) further has a second projection (30) projecting from the second side edge (28) of the first coupling portion (22A), and wherein the groove (42) is a first groove (42), and the terminal accommodating portion (36) of the housing (12) further has a second groove (42) opposed to the first groove (42), the second projection (30) being engaged in a second groove (42).

5. The connector of claim 1, wherein:

the terminal connecting portion (18) is open rearward; and the first coupling portion (22A) is connected to a rear opening edge located on a side opposite to the second coupling portion (22B) in the second direction.

6. The connector of claim 1, wherein the first coupling portion (22A) has opposite first and second side edges (28), the projection (30) is a first projection (30) and projects from the first side edge (28) of the first coupling portion (22A), and the terminal (14) further has a second projection (30) projecting from the second side edge (28) of the first coupling portion (22A), and wherein the groove (42) is a first groove (42), and the terminal accommodating portion (36) of the housing (12) further has a second groove (42) opposed to the first groove (42), the second projection (30) being engaged in a second groove (42).

* * * * *